United States Patent [19]

Sakaguchi et al.

[11] 4,367,690

[45] Jan. 11, 1983

[54] HEATED ROLLER TYPE FIXING APPARATUS

[75] Inventors: Hirofumi Sakaguchi; Ken-ichi Matsumoto; Keiji Masuda, all of Hachioji, Japan

[73] Assignee: Konishiroku Photo Industry Co., Ltd., Japan

[21] Appl. No.: 226,735

[22] Filed: Jan. 21, 1981

[30] Foreign Application Priority Data

Jan. 21, 1980 [JP] Japan ..... 55/5630[U]

[51] Int. Cl.[3] ..... G03G 15/20

[52] U.S. Cl. ..... 118/60; 118/101; 118/104; 432/60

[58] Field of Search ..... 118/60, 104, 644, 101; 355/3 FU; 432/60

[56] References Cited

U.S. PATENT DOCUMENTS 4,081,213 3/1978 Bar-on et al. ..... 355/3 FU

*Primary Examiner*—Evan K. Lawrence

*Attorney, Agent, or Firm*—Jordan B. Bierman; Linda Bierman

[57] ABSTRACT

A fixing apparatus includes a first, heated roller and a second roller movable from spaced apart condition in their nonoperative mode into mutual pressure contact with each other for operatively fixing a toner image to a support sheet passed therebetween, and a cleaning blade maintained in continuous contact with the first roller to clean contaminating matter from its surface. In operation, the first roller is rotated through at least one full revolution prior to contact with the second roller so that residual contaminating matter can be cleaned from the first roller surface before contact with the second roller and image fixing take place.

1 Claim, 3 Drawing Figures

HEATED ROLLER TYPE FIXING APPARATUS

FIELD OF THE INVENTION

The present invention relates to a fixing apparatus utilizing a heated roller contact heating system, and more particularly to an improvement in heated roller type fixing apparatus wherein thermoplastic toner is fixed to a support by contact heating.

BACKGROUND OF THE INVENTION

In a well known heated roller type fixing apparatus, two rollers—one of which is heated—are rotated in a condition of pressure contact with each other and a support (typically a sheet of paper) bearing an unfixed toner image on one face thereof is inserted between and for passage through the rollers. The first roller, which contacts the toner image borne on the support, is formed of a heat conductive metal such as brass and aluminum in the shape of a tube. A coating of a thermolubricity resistance material such as tetrafluoroethylene is provided on the tube periphery, and a heat source is disposed within its interior to thereby heat the roller's surface. The second roller, which is maintained for image fixing in pressing contact with the first roller, is formed of an elastic rubber such as silicon rubber.

During periods of nonoperation—i.e. when no toner image fixing is being performed—it is known to hold the two rollers in spaced apart relation so as to define a gap therebetween and to discontinue roller rotation (typically of the first or heated roller) until the next fixing operation. This may be done for a number of reasons, such as to enable the temperature of the surface of the first roller to be raised to a predetermined temperature within the shortest possible period of time, or to avoid permanent shape distortion of the elastic rubber of the second roller resulting from continued pressure contact with the first roller, or to protect against degradation of the roller rubber caused by high temperature, or to provide the ability to readily clear a paper jam occurring when the image support is transported and fixed.

Such prior art heated roller type fixing apparatus, however, suffer from an operating deficiency as shall now be described. In heated roller fixation, the support carrying thermoplasticizing toner is passed through the nip between the first or heated roller and the second roller in pressure contact therewith; the toner is fused by the heated roller and thereby fixed to the support. However, it is difficult to fix 100% of the toner to the support and additionally to keep the surface of the first roller entirely clean, and some of the unfixed toner residue and contamination from the support may become adhered to the first roller surface. As a countermeasure and in order to remove the toner residues and contamination which adhere to the first roller, a cleaning blade is provided in continuous contact with the first roller's heated surface.

In the course of repetitive copying operations, the toner residues accumulate at the contact position of the first roller with the cleaning blade, and these accumulated residues will solidify on the roller surface when copying operations are completed and the internal roller heat source is turned off. In this regard, it should be understood that in such conventional heated roller type fixing apparatus, no initiation of copying operations the first roller is heated and, following that, first roller rotation and pressing contact with the second roller commence almost simultaneously. A portion of the heated toner residues located on the first roller surface at the contact point with the cleaning blade may become separated from the cleaning blade and migrate to the surface of the pressing second roller from which they can adhere and be transferred to the rear or nonimage-bearing face of the passing support. This obviously has the serious and undesired effect, among others, of producing lowered copy quality.

SUMMARY OF THE INVENTION

It is therefore the object of the present invention to eliminate these problems by cleaning the first roller surface of the residual mixture which adheres thereto before said residual mixture comes into contact with the second roller, thereby preventing migration of said residual mixture onto the second roller.

The disclosed embodiment of the present invention accordingly provides a first roller having a built-in heat source and which is rotated by a separate power source, a cleaning blade maintained in continuous contact with the surface of the first roller, and a second roller having an elastic surface. The first and second rollers are brought into pressure contact with each other during each copying operation, but are held in spaced apart relation to define a gap therebetween during periods of nonoperation. More particularly, the apparatus of the present invention provides that, at the initiation of a copying operation, the first roller is brought into pressure contact with the second roller only after the first roller has been rotated through at least one full revolution.

BRIEF DESCRIPTION OF THE DRAWING

In the Drawing, wherein like reference numerals identify similar parts throughout the several views:

FIGS. 2 and 3 are enlarged side views diagrammatically showing details of the arrangement of parts in the central portion of FIG. 1, wherein FIG. 2 illustrates the nonoperating state of the apparatus and FIG. 3 shows the operating state.

DETAILED DESCRIPTION OF THE PREFERRED EMBODIMENT

Figure 1:
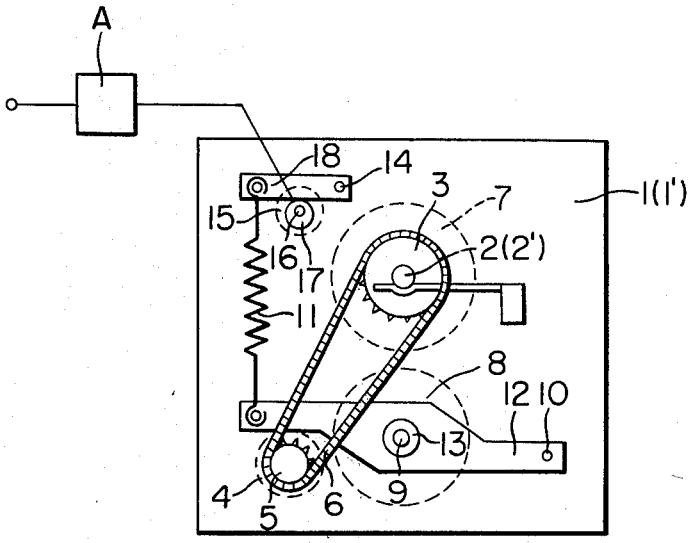
FIG. 1 is an elevated side view diagrammatically showing a heated roller type fixing apparatus constructed in accordance with the teachings of the present invention.

Referring now to FIG. 1, reference numeral 1 identifies one of two side plates 1, 1' of the main frame of the fixing apparatus and between which the fixing mechanism is supported. Side plate 1 supports one end 2 of a shaft about which the first or heated roller 7 is disposed, the other side plate 1' supporting the opposite shaft end 2' of the first roller. A sprocket 3 is fixed to shaft end 2, and a motor 4 depicted by a dotted line is provided with a small sprocket 5 fixed thereto. Sprockets 3 and 5 are connected through a chain 6 so that first roller 7 is rotated by operative revolution of motor 4.

One end of a shaft 9 of a second roller 8 is supported at a bearing 13 by a lever 12 which is pivotable about a fixed pin 10 by action of a spring 11 fixed to lever 12 at one of its ends. The other end of spring 11 is connected to the movable end of a lever 18 pivotable about a fixed pin 14. Lever 18 is pivotted by an ecentric cam 17 which rotates about a shaft 16 through a driving power source 15 shown in dotted line; the connection of levers 12 and 18 through spring 11 causes second roller 8 to be moved into pressing contact with first roller 7 during copying operations.

Figure 2:
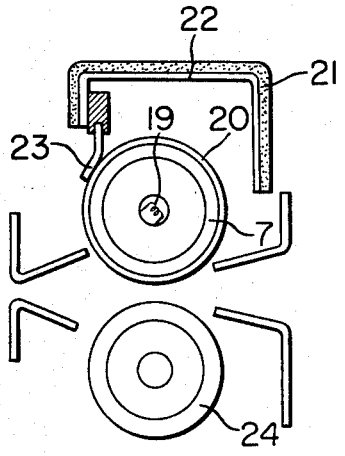
Figure 3:
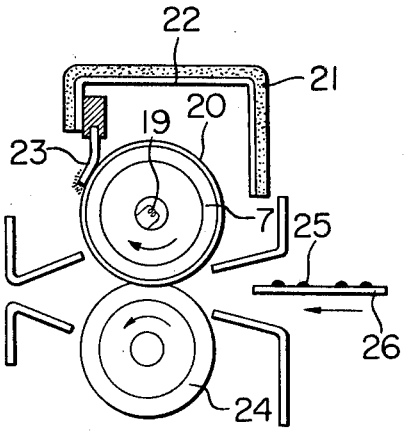

FIG. 2 illustrates the state of the rollers when no copying operations are being performed (and also when first roller 7 is initially heating up), while FIG. 3 shows the condition in which second roller 8 is maintained in pressing contact with first roller 7 while copying operations are taking place. First roller 7 comprises a heat conductive metal cylinder within which is provided a heater 19, and a coated layer 20 having thermolubricity resistance on the roller surface. First roller 7 is partially enveloped by a heat insulative cover 22 carrying an insulator 21 on its surface. A cleaning blade 23 mounted on heat insulative cover 22 is held in continuous contact with the surface of first roller 7 and serves to remove contamination and toner residues which adhere to the roller surface. Second roller 8 is provided with an outer surface layer 24 of silicon rubber.

During copying, second roller 8 is pressed against heated first roller 7 which is rotatively driven by motor 4. Support 26 bearing unfixed thermoplastic toner image 25 is inserted into the nip between the two rollers whereby the image is fixed thereto. In prior art devices, when copying operations are begun the second roller is moved into pressure contact with the first roller at almost the same time that the first roller starts to rotate. The present invention, on the other hand, provides a time delay (by operation of an electric control circuit A) after motor 4 for driving first roller 7 is actuated and before second roller 8 is moved into pressure contact therewith. More particularly, driving power source 15 for causing second roller 8 to be moved into contact with first roller 7 is actuated only after the first roller has been rotated (by motor 4 and chain 6) through at least one complete revolution. In addition, where a reduction motor is utilized as driving power source 15, suitable selection of the reduction ratio thereof can enable such prerotation of the first roller prior to contact with the second roller even if both motor 4 and driving power source 15 are switched on or actuated at the same time. In either case, a heated roller type fixing apparatus of this construction effectively prevents contamination of the second roller and avoids the production of stained copies otherwise resulting from such contamination.

The cleaning blades for use in the present invention may utilize conventional coatings known in the art and which are effective for both removal of residual contamination and replenishment of silicon oil. Furthermore, although the time lag or delay between the start of first roller rotation and subsequent contact between the first and second rollers has been described as being produced by an electric circuit, such delay may alternatively be implemented by mechanical means.

We claim:

1. In a fixing apparatus operable for substantially permanently affixing a toner image to a sheet, and including a first rotatable roller having a heat source therein for heating the peripheral surface of the roller, a cleaning blade disposed in contact with the peripheral surface of said first roller for removing foreign matter therefrom, a second rotatable roller having a peripheral surface normally spaced from said first roller surface, said first and second rollers being normally maintained non rotatably stationary and relatively spaced apart during nonoperation of said fixing apparatus, means for moving at least one of said rollers into peripheral surface pressure contact with the other of said rollers during operation of said fixing apparatus so that a toner image on a sheet passing between the two rollers is fixed to the sheet by the heated first roller, and means for causing rotation of said first and second rollers when said first and second rollers are relatively moved into peripheral surface pressure contact with each other, the improvement comprising:

means for initiating rotation of said first roller prior to said relative movement of the rollers into contact with each other so that said first roller is caused to rotate through at least one complete revolution prior to contact with said second roller whereby foreign matter is removed from the peripheral surface of said first roller by said cleaning blade prior to contact with the peripheral surface of said second roller.

* * * * *